US009669451B2

(12) United States Patent
Choi

(10) Patent No.: US 9,669,451 B2
(45) Date of Patent: Jun. 6, 2017

(54) HEMMING DEVICE OF PANEL AND MANUFACTURING METHOD THEREOF

(71) Applicant: Hyundai Motor Company, Seoul (KR)

(72) Inventor: Wooyoung Choi, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/935,646

(22) Filed: Nov. 9, 2015

(65) Prior Publication Data

US 2017/0014892 A1 Jan. 19, 2017

(30) Foreign Application Priority Data

Jul. 13, 2015 (KR) ..... 10-2015-0099203

(51) Int. Cl.
*B21D 39/02* (2006.01)
*B21D 19/08* (2006.01)

(52) U.S. Cl.
CPC ..... *B21D 39/021* (2013.01)

(58) Field of Classification Search
CPC .... B21D 19/08; B21D 19/082; B21D 19/084; B21D 19/086; B21D 39/023; B21D 39/021; B21D 39/02; B21D 43/06
See application file for complete search history.

(56) References Cited

U.S. PATENT DOCUMENTS 4,346,579 A * 8/1982 Takatsu ..... B21D 39/021 29/243.58
5,647,243 A * 7/1997 Zampini ..... B21D 39/021 72/312
6,295,858 B1 * 10/2001 Torito ..... B21D 39/021 29/243.58
7,640,779 B2 * 1/2010 Sasahara ..... B21D 39/021 100/266

FOREIGN PATENT DOCUMENTS

JP 2569858 B2 1/1997
KR 10-0520534 B1 10/2005

* cited by examiner

*Primary Examiner* — Teresa M Ekiert
(74) *Attorney, Agent, or Firm* — Mintz Levin Cohn Ferris Glovsky and Popeo, P.C.; Peter F. Corless

(57) ABSTRACT

A hemming device is provided including a lower die, an exterior panel disposed at the lower die, and an interior panel disposed on the exterior panel and bending an edge flange portion of the exterior panel to be adjacent to the interior panel. The hemming device further includes a hemming multi-cam formed with a first hemming surface primarily bending the flange portion of the exterior panel and formed with a second hemming surface secondarily bending the flange part at one side of the first hemming surface. Additionally, a seesaw cam having a tip end portion formed with a cam tip end surface bonds the interior panel to the exterior panel and bends the flange portion secondarily bent by the second hemming surface to be adjacent to the exterior surface of the interior panel.

9 Claims, 7 Drawing Sheets

HEMMING DEVICE OF PANEL AND MANUFACTURING METHOD THEREOF

CROSS-REFERENCE TO RELATED APPLICATION

This application claims priority to and the benefit of Korean Patent Application No. 10-2015-0099203 filed in the Korean Intellectual Property Office on Jul. 13, 2015, the entire contents of which are incorporated herein by reference.

BACKGROUND (a) Field of the Invention

The present invention relates to a hemming device for a panel that bends an edge of an exterior panel adhered to an interior panel using a spare hemming cam and a main hemming cam to adhere the exterior panel to the interior panel, and a manufacturing method thereof.

(b) Description of the Related Art

Generally, the first step of a manufacturing process of a vehicle includes forming a vehicle body. Specifically, a vehicle body in white (BIW) is manufactured by producing panels with various presses, delivering the panels to a vehicle body factory, and assembling the panels. Typically, a vehicle door includes an interior panel and an exterior panel, and the panels are bonded to each other using a hemming process. The hemming process includes a bonding process where the ends of the panels are folded and superimposed to have a bonding shape where the end of the exterior panel of the door encloses (e.g., is bent around) the end of the interior panel. Throughout the hemming process, an upper mold and a lower mold manufactured along the shape of each door are installed to a hemming press, and the panels are set between the molds for performing the hemming process.

A conventional hemming device includes a first hemming cam and a second hemming cam to bend the panels, and a main cam for bending and coupling the panels together. Accordingly, since the conventional hemming device includes three hemming cams, the productivity decreases due to the hemming process, and the design time increases due to the complex hemming structure thereby increasing production costs, and an increase of the number of manufacturing processes.

Furthermore, to remove assembly interference for a hood or a tail gate portion of the vehicle body, the exterior panel is bent 105 degrees or more, thus when the bending angle is substantial, a first pre-hemming step, a second pre-hemming step, and a main hemming step are sequentially performed. FIG. 1 illustrates an exemplary schematic diagram of a hemming device for a panel according to an exemplary embodiment of the present invention. Referring to FIG. 1, the hemming device includes a lower die 100, an exterior panel 110, an interior panel 105, a pad cam 115, a first hemming cam 120, a second hemming cam 125, and a main cam 130.

The exterior panel 110 is disposed on the lower die 100 and the interior panel 105 is disposed thereon. Additionally, the pad cam 115 contacts the portion of the exterior panel 110 to be bent, and the first hemming cam 120 bends the edge portion of the exterior panel 110, a flange part. Further, the pad cam 115 is separated, the second hemming cam 125 bends the flange portion of the exterior panel 110, and the main cam 130, while articulating (e.g., moving) longitudinally (e.g., from top to bottom), bends a flange portion 400 of the exterior panel 110 and contacts the exterior panel to the edge surface of the interior panel 105 for bonding. In other words, the pad cam 115, the first hemming cam 120, the second hemming cam 125, and the main cam 130 are translated (e.g., moved) and slide via the flange portion of the exterior panel 110 while the main cam 130 is disposed in the vertical direction, such that the bending, etc. may be generated on the exterior thereof.

The above information disclosed in this section is only for enhancement of understanding of the background of the invention and therefore it may contain information that does not form the prior art that is already known in this country to a person of ordinary skill in the art.

SUMMARY

The present invention provides a hemming device of a panel thereby reducing a number of hemming cams and improving the bonding quality between the exterior panel and the interior panel and the exterior quality of the vehicle body, and a manufacturing method thereof.

According to an exemplary embodiment of the present invention, a hemming device of a panel may include a lower die, an exterior panel disposed at the lower die, and an interior panel disposed on the exterior panel and bending an edge flange portion of the exterior panel to contact (e.g., abut) the interior panel. Furthermore, a hemming multi-cam may be formed with a first hemming surface that bends (e.g., primarily bending) the flange portion of the exterior panel and forms a second hemming surface that bends (e.g., secondarily bends) the flange portion at one side of the first hemming surface. A seesaw cam may include a tip end portion formed with a cam tip end surface closing the interior panel to the exterior panel and bending the flange portion secondarily bent (e.g., secondarily bent) by the second hemming surface adjacent to the exterior surface of the interior panel.

In some exemplary embodiments, the cam tip end surface of the seesaw cam may be formed with a protrusion having a height that corresponds to a thickness of the interior panel, and the cam tip end surface may be adjacent to the exterior surface of the interior panel. The protrusion tip end surface of the protrusion may enclose the exterior surface of the exterior panel.

In other exemplary embodiments, the seesaw cam may be formed with a supporting surface, and the protrusion tip end surface may be adjacent to the exterior surface of the exterior panel and the cam tip end surface may be adjacent to the exterior surface of the interior panel. Further, the first hemming surface of the hemming multi-cam may bend the flange portion of the exterior panel by a predetermined angle so that the flange portion may be adjacent to the supporting surface. In other exemplary embodiments, a seesaw cam driver may translate (e.g., move) the seesaw cam within a predetermined trajectory (e.g., route), and a multi-cam driver may translate (e.g., move) the hemming multi-cam within a predetermined route. The seesaw cam driver may include a seesaw mounted with the seesaw cam at one side, and a seesaw cylinder lifting or pressing one side of the seesaw to displace (e.g., move) the seesaw cam.

In addition, the multi-cam driver may include a body mounted with the hemming multi-cam, a hemming roller that may be disposed at the body to be rotatable and a cam base mounted with the body at one side and may be disposed to translate (e.g., be movable) along the body and the hemming multi-cam. The multi-cam driver may further include a sliding plate disposed under (e.g., beneath) the cam base and a return spring that may elastically support the cam base to be returned. A hemming roller may be disposed to press the hemming roller along the cam body; and a hemming cam driver may move the hemming roller cam. The hemming roller cam may include, a first hemming roller cam that may primarily press the hemming roller while translating (e.g., moving) in a vertical (e.g., an up/down) direction and a second hemming roller cam that may secondarily press the hemming roller by a predetermined distance with the second hemming roller cam.

In another aspect of the exemplary embodiments a hemming method may include disposing an exterior panel on a lower die and disposing an interior panel on the exterior panel. The hemming method may further include pressing an exterior surface of the interior panel using a cam tip end surface of the seesaw cam to bond the interior panel and the exterior panel to each other and primarily bending an edge flange portion of the exterior panel using the first hemming surface of the hemming multi-cam with a predetermined angle. The seesaw cam may be separated to bond the exterior surface of the interior panel and secondarily bending the flange portion of the exterior panel with a predetermined angle using the second hemming surface of the hemming multi-cam. The method may further include, bending the flange portion using the cam tip end surface of the seesaw cam to contact the flange portion with the interior panel.

Further, the interior panel and the exterior panel may be bonded together and a protrusion tip end surface of a protrusion that extends from the cam tip end surface of the seesaw cam may be adjacent to the exterior surface of the exterior panel. The flange portion may be bent (e.g., primarily bent) having the predetermined angle and the flange portion of the exterior panel may be bent to abut the supporting surface formed at one side of the seesaw cam.

According to the exemplary embodiments, the bending angle of the exterior panel may be about 105 degrees or greater, and the primary hemming and the secondary hemming may be performed using one multi-hemming cam. The main hemming may be performed using the seesaw cam, thereby reducing the number of cams, improving the exterior quality, and enhancing a bonding force. Furthermore, the seesaw cam may perform a pad function, thereby reducing the number of hemming cams and reducing costs.

BRIEF DESCRIPTION OF THE DRAWINGS

The above and other features of the present disclosure will be apparent from the following detailed description when taken in conjunction with the accompanying drawings, in which.

DETAILED DESCRIPTION

Advantages and features of the invention and methods of accomplishing the same may be understood more readily by reference to the following detailed descriptions of exemplary embodiments and the accompanying drawings. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, in order to make the description of the present invention clear, unrelated parts are not shown and, the thicknesses of layers and regions are exaggerated for clarity. Further, when it is stated that a layer is "on" another layer or substrate, the layer may be directly on another layer or substrate or a third layer may be disposed therebetween.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Figure 1:
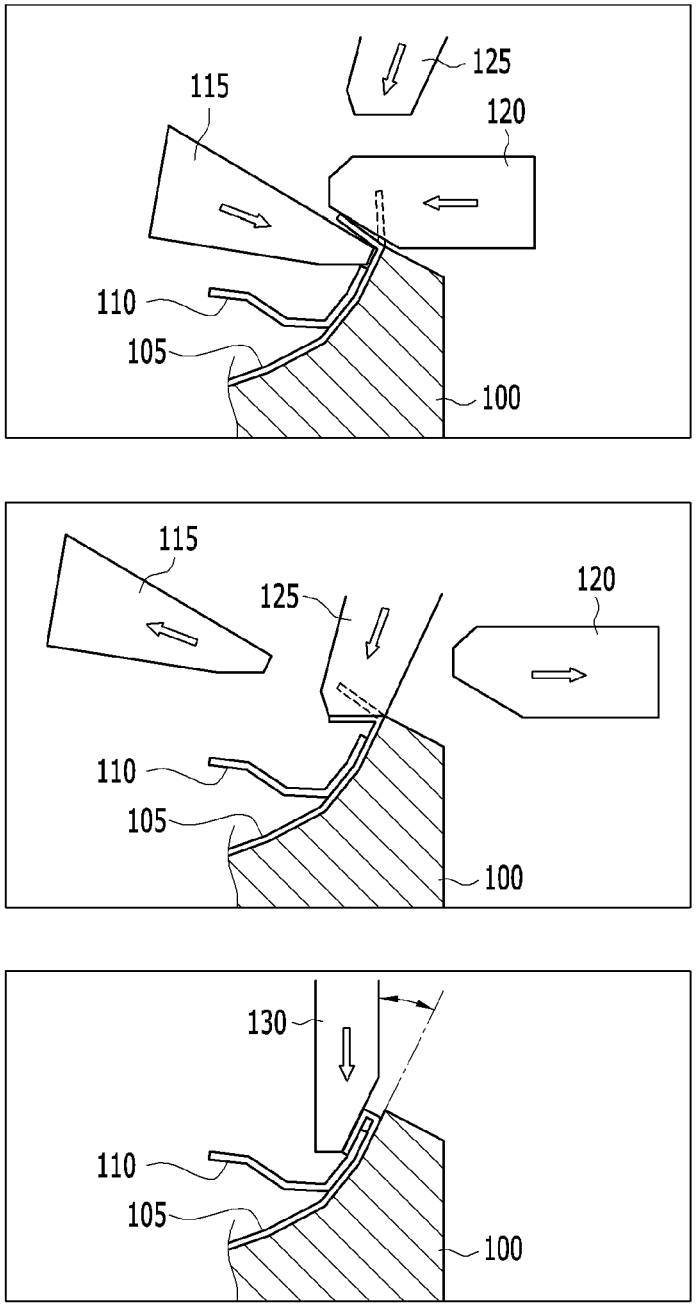
FIG. 1 is an exemplary schematic diagram of a hemming device of a panel related to an exemplary embodiment of the present invention.
Figure 2:
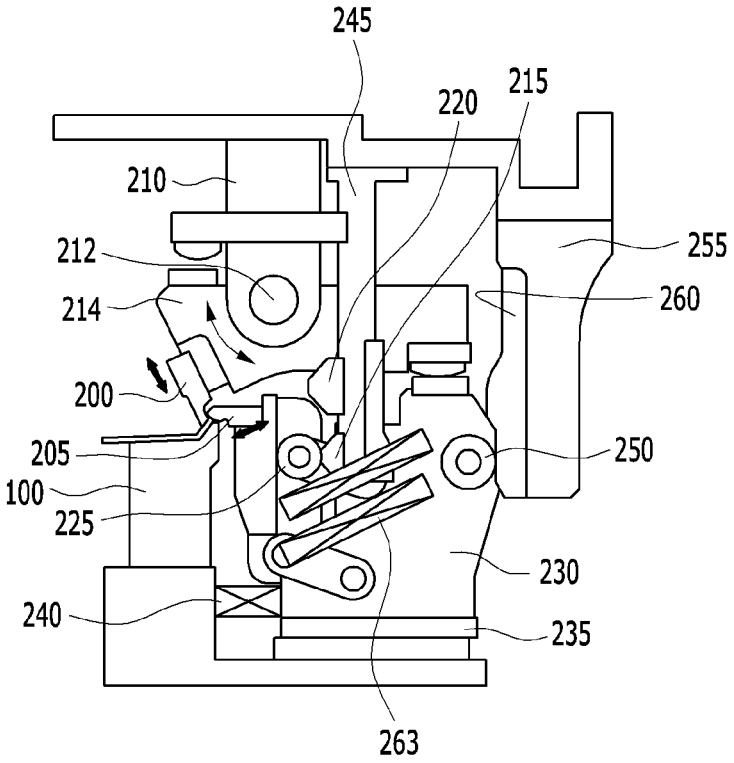
FIG. 2 is an exemplary schematic lateral view of a hemming device of a panel according to an exemplary embodiment of the present invention.

FIG. 2, illustrates an exemplary schematic lateral view of a hemming device of a panel according to an exemplary embodiment of the present invention. Referring to FIG. 2, the hemming device of the panel may include a seesaw cam 200, a seesaw 214, a lower die 100, a hemming multi-cam 205, a cam return spring 263, a multi-cam body 207, a hemming roller 225, a base return spring 240, a sliding plate 235, a cam base 230, a base roller 250, a base roller cam 260, a base cam driver 255, a first hemming roller cam 215, a second hemming roller cam 220, a hemming cam driver 245, a seesaw cylinder 210, and a hinge 212. As described above, the seesaw cam 200 and the hemming multi-cam 205 may perform hemming work. The seesaw cam 200 may be disposed at one end portion of the seesaw 214, and the seesaw cam driver may include the seesaw cylinder 210. The seesaw cylinder 210 may be configured to translate (e.g., move) one side of the seesaw 214 in a vertical direction (e.g., up and down) around the hinge 212 to translate (e.g., move) the seesaw cam 200 along a predetermined trajectory.

In particular, the multi-cam driver may be disposed to operate the hemming multi-cam 205 and the multi-cam driver may include the cam base 230, the sliding plate 235 that may be disposed under (e.g., beneath) the cam base 230, and the base return spring 240 that may be disposed to elastically translate (e.g., push) the cam base 230. Further, the base roller 250 may be disposed on the cam base 230, the base cam driver 255 may be disposed to translate (e.g., move) the base roller cam 260 in the vertical direction (e.g., up/down direction), and the base roller cam 260 may be disposed to translate (e.g., push) the base roller 250 while translating (e.g., moving) in the vertical (e.g., up/down) direction.

Moreover, the multi-cam body 207 may be disposed at one side of the cam base 230, the hemming multi-cam 205 may be disposed at the tip end portion of the multi-cam body 207, and the hemming roller 225 may be disposed at one surface of the multi-cam body 207. Additionally, the cam return spring 263 may be disposed to elastically translate (e.g., pull) the multi-cam body 207 to the side of (e.g., adjacent to) the cam base 230. For example, in an exemplary embodiment, the first hemming roller cam 215 and the second hemming roller cam 220 may be disposed in the vertical (e.g., up/down) direction at the hemming cam driver 245, the first hemming roller cam 215 may be configured to displace (e.g., pushes) the hemming roller 225 that may primarily perform the bending, and the second hemming roller cam 220 may be configured to displace (e.g., pushes) the hemming roller 225 that may secondarily perform bending.

Figure 3:
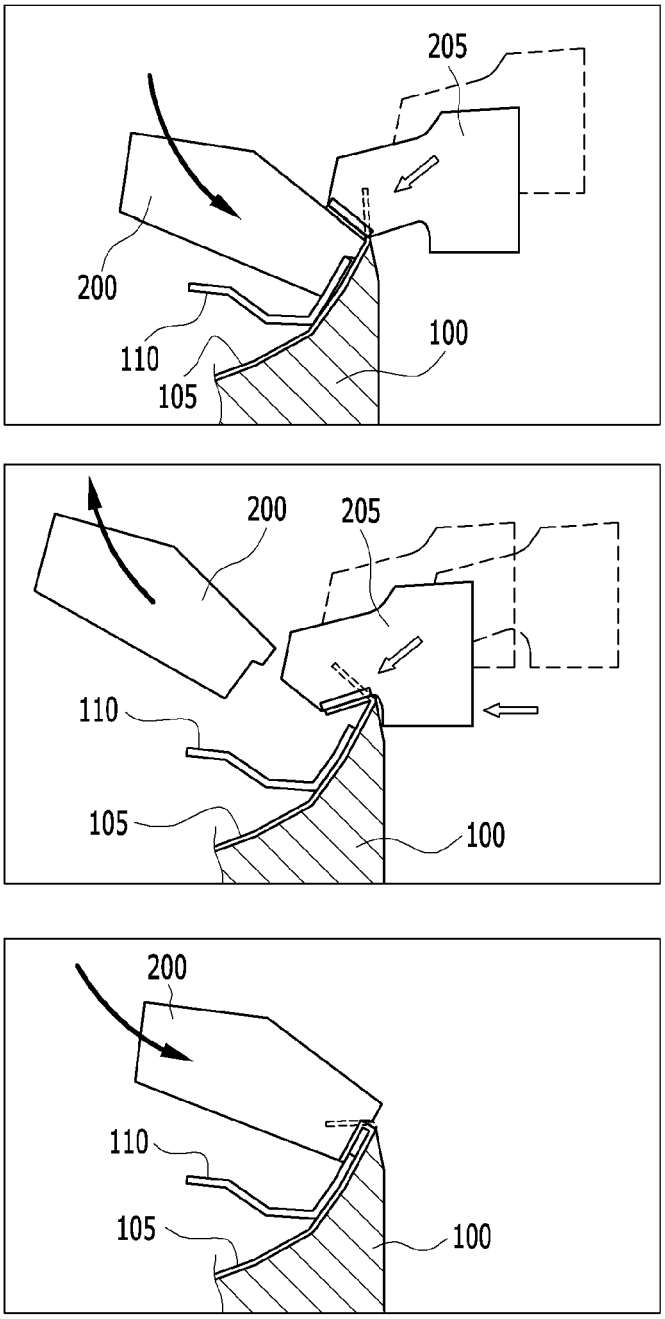
FIG. 3 is an exemplary partial lateral view illustrating a hemming process of a hemming device of a panel according to an exemplary embodiment of the present invention.

FIG. 3 illustrates an exemplary, partial lateral view of a hemming process of a hemming device of a panel according to an exemplary embodiment. Referring to FIG. 3, the exterior panel 110 and the interior panel 105 may be sequentially disposed to overlap on the lower die 100, and the seesaw cam 200 may be disposed to simultaneously fix (e.g. adhere or bond) the exterior panel 110 and the interior panel 105. For example, when the seesaw cam 200 is fixed (e.g., locked or held into a static position), the hemming multi-cam 205 may primarily bend the flange portion (400 of FIG. 4) of the exterior panel 110 by about 90 degrees. Additionally, the seesaw cam 200 may be separated from the exterior panel 110 and the interior panel 105. In other words, when the seesaw cam 200 separates, while the hemming multi-cam 205 may be actuated (e.g., moved) along a predetermined trajectory (e.g., route), the hemming multi-cam 205 may secondarily bend the flange portion 400 of the exterior panel 110 by about 45 degrees. Additionally, the hemming multi-cam 205 may be separated. In particular, the hemming multi-cam 205 may be separated, while the seesaw cam 200 is moved along the predetermined trajectory, the tip end surface of the seesaw cam 200 completely bends the flange portion 400 of the exterior panel 110 to contact the flange portion of the exterior panel 110 to the edge surface of the interior panel 105.

Figure 4:
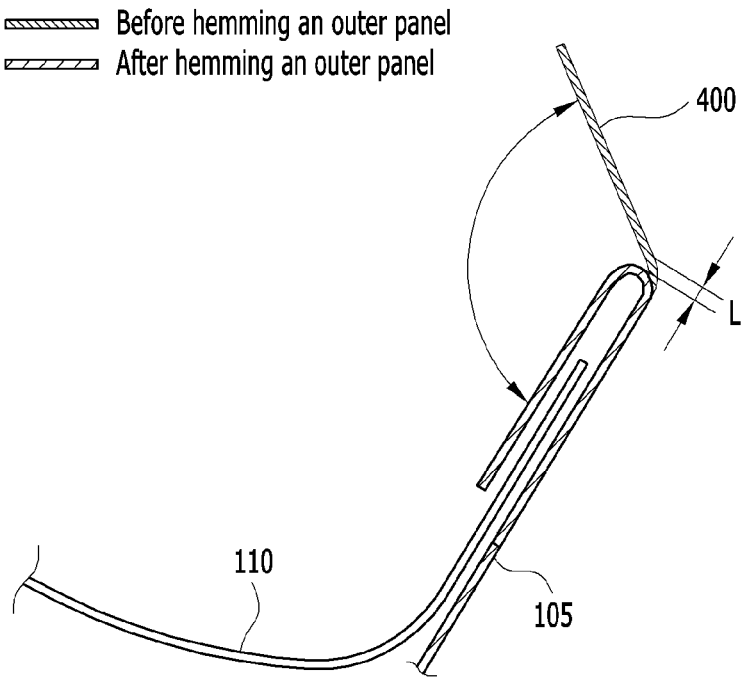
FIG. 4 is an exemplary partial cross-sectional view illustrating a part of a panel processed by a hemming device according to an exemplary embodiment of the present invention.

FIG. 4 is an exemplary partial cross-sectional view showing a portion of a panel processed by a hemming device according to an exemplary embodiment of the present invention. Referring to FIG. 4, the edge flange portion 400 of the exterior panel 110 may have the structure that may be bent greater than about 100 degrees, and a hemming depression length L may be minimized (e.g., reduced) by the hemming process.

Figure 5:
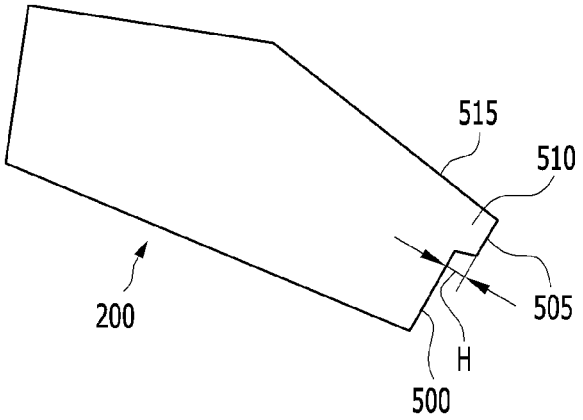
FIG. 5 is an exemplary partially detailed lateral view of a seesaw cam according to an exemplary embodiment of the present invention.

FIG. 5 is an exemplary partially detailed lateral view of a seesaw cam according to an exemplary embodiment of the present invention. Referring to FIG. 5, the seesaw cam 200 may include a supporting surface 515, a protrusion 510, a protrusion tip end surface 505, and a cam tip end surface 500. The protrusion 510 may have a predetermined length that may be formed to protrude at the upper side of the tip end surface of the seesaw cam 200. Further, the protrusion tip end surface 505 of the protrusion 510 may be formed to apply pressure to (e.g., press) the exterior panel 110, and the cam tip end surface 500 of the seesaw cam 200 may be formed to apply pressure (e.g., press) the interior panel 105.

In an exemplary embodiment of the present invention, the seesaw cam 200 may be formed having the cam tip end surface 500 apply pressure to (e.g., press) the interior panel 105, and simultaneously the protrusion tip end surface 505 may apply pressure (e.g., press) the exterior panel 110. Accordingly, a height H of the protrusion 510 may correspond to the thickness of the interior panel 105. The supporting surface 515 may be formed at the upper portion of the seesaw cam 200. For example, the seesaw cam 200 may fix (e g, maintain a static position) of the exterior panel 110 and the interior panel 105. Further, the flange portion 400 of the exterior panel 110 may be bent by the angle that corresponds to the supporting surface 515 of the seesaw cam 200.

Figure 6:
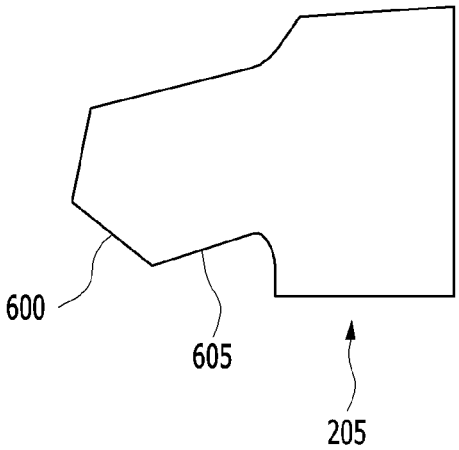
FIG. 6 is an exemplary partially detailed lateral view of a hemming multi-cam according to an exemplary embodiment of the present invention.

FIG. 6 is an exemplary partially detailed lateral view of a hemming multi-cam according to an exemplary embodiment of the present invention. Referring to FIG. 6, the hemming multi-cam 205 may include a first hemming surface 600 and a second hemming surface 605. The first hemming surface 600 may be a surface that primarily bends the flange portion 400 of the exterior panel 110, and the second hemming surface 605 may be a surface that secondarily bends the flange portion 400 of the exterior panel 110. The first hemming surface 600 and the second hemming surface 605 may be formed at the lower surface of the hemming multi-cam 205 and may include a predetermined angle. The first hemming surface 600 may be formed on the front side of the second hemming surface 605.

Figure 7:
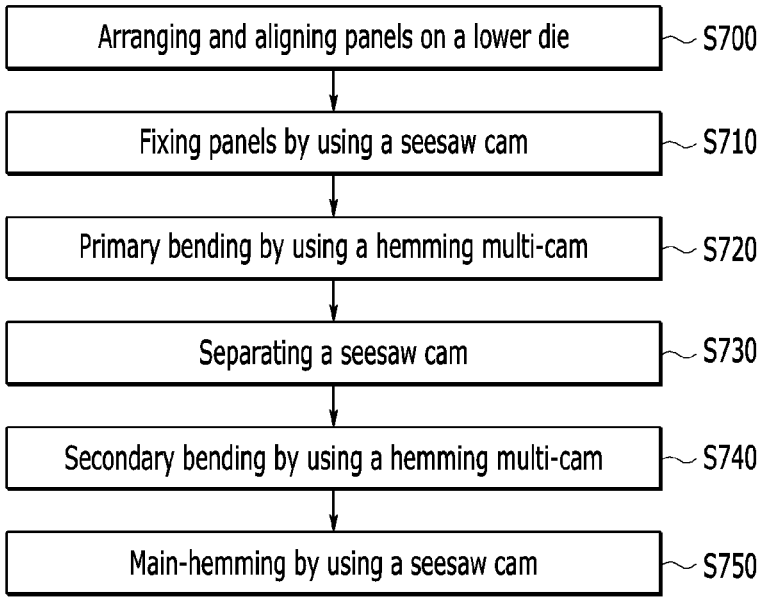
FIG. 7 is an exemplary flowchart showing a hemming sequence according to an exemplary embodiment of the present invention.

FIG. 7 is an exemplary a flowchart that illustrates a hemming sequence according to an exemplary embodiment of the present invention. Referring to FIG. 7, the exterior panel 110 and the interior panel 105 may be sequentially deposited and aligned on the lower die 100 S700. Further, the interior panel 105 may be positioned adjacent to the exterior panel 110 and the exterior panel 110 may be fixed (e.g., held in a static position) by using the protrusion tip end surface 505 and the cam tip end surface 500 of the seesaw cam 200 S710. In particular, by utilizing the first hemming surface 600 of the hemming multi-cam 205 S720, the flange portion 400 of the exterior panel 110 may primarily bend the exterior panel 110 to be adjacent to the flange supporting surface 515 of the seesaw cam 200. The seesaw cam 200 may be separated S730, and the bending may be secondarily performed by using the second hemming surface 605 of the hemming multi-cam 205 S740. Additionally, the main hemming may be performed using the cam tip end surface 500 of the seesaw cam 200 S750.

While this invention has been described in connection with what is presently considered to be exemplary embodiments, it is to be understood that the invention is not limited to the disclosed exemplary embodiments. On the contrary, it is intended to cover various modifications and equivalent arrangements without departing from the spirit and scope as disclosed in the accompanying claims.

DESCRIPTION OF SYMBOLS

100: lower die
105: interior panel
110: exterior panel
115: pad cam
120: first hemming cam
125: second hemming cam
130: main cam
200: seesaw cam
205: hemming multi-cam
207: multi-cam body
210: seesaw cylinder
212: hinge
214: seesaw
215: first hemming roller cam
220: second hemming roller cam
225: hemming roller
230: cam base
235: sliding plate
240: base return spring
245: hemming cam driver
250: base roller
255: base cam driver
260: base roller cam
263: cam return spring
400: flange portion
500: cam tip end surface
505: protrusion tip end surface
510: protrusion
515: supporting surface
600: first hemming surface
605: second hemming surface

What is claimed is:

1. A hemming device of a panel including a lower die, an exterior panel disposed at the lower die, and an interior panel disposed on the exterior panel and bending an edge flange portion of the exterior panel adjacent to the interior panel, comprising:

a hemming multi-cam formed with a first hemming surface primarily bending the flange portion of the exterior panel and formed with a second hemming surface secondarily bending the flange portion at one side of the first hemming surface; and a seesaw cam having a tip end portion formed with a cam tip end surface that bonds the interior panel to the exterior panel and bending the flange portion secondarily bent by the second hemming surface to be adjacent to the exterior surface of the interior panel, wherein the cam tip end surface of the seesaw cam includes a protrusion having a height that corresponds to a thickness of the interior panel; and the cam tip end surface is adjacent to the exterior surface of the interior panel so that a protrusion tip end surface of the protrusion bonds to the exterior surface of the exterior panel, and wherein the seesaw cam is formed with a supporting surface, and the protrusion tip end surface is adjacent to the exterior surface of the exterior panel and the cam tip end surface is adjacent to the exterior surface of the interior panel, the first hemming surface of the hemming multi-cam bends the flange portion of the exterior panel by a predetermined angle so that the flange portion is adjacent to the supporting surface.

2. The hemming device of claim 1, further comprising:

a seesaw cam driver configured to move the seesaw cam with a predetermined trajectory; and a multi-cam driver configured to move the hemming multi-cam with a predetermined trajectory.

3. The hemming device of claim 2, wherein the seesaw cam driver includes:

a seesaw mounted with the seesaw cam at one side; and a seesaw cylinder lifting or pressing one side of the seesaw to translate the seesaw cam.

4. The hemming device of claim 2, wherein the multi-cam driver includes:

a body mounted with the hemming multi-cam;

a hemming roller disposed at the body to be rotatable;

a cam base mounted with the body at one side and disposed to translate along the body and the hemming multi-cam.

5. The hemming device of claim 2, wherein the multi-cam driver further includes:

a sliding plate disposed under the cam base;

a return spring elastically supporting the cam base to be returned;

a hemming roller configured to apply pressure along a cam body; and a hemming cam driver translating the hemming roller cam.

6. The hemming device of claim 5, wherein the hemming roller cam includes:

a first hemming roller cam primarily pressing the hemming roller while translating in a vertical direction; and a second hemming roller cam secondarily pressing the hemming roller by a predetermined distance with the second hemming roller cam.

7. A method for hemming a panel, comprising:

disposing an exterior panel on a lower die and disposing an interior panel on the exterior panel;

pressing an exterior surface of the interior panel using a cam tip end surface of a seesaw cam to bond the interior panel and the exterior panel to each other;

primarily bending an edge flange portion of the exterior panel using a first hemming surface of the hemming multi-cam with a predetermined angle;

separating the seesaw cam proximate to the exterior surface of the interior panel and secondarily bending the flange portion of the exterior panel with a predetermined angle using a second hemming surface of the hemming multi-cam; and bending the flange portion by using the cam tip end surface of the seesaw cam so that the flange portion contacts the interior panel.

8. The method of claim 7, wherein, in closing the interior panel and the exterior panel to each other, a protrusion tip end surface of a protrusion that protrudes from the cam tip end surface of the seesaw cam is adjacent to the exterior surface of the exterior panel.

9. The method of claim 7, wherein, in primarily bending the flange portion with the predetermined angle, the flange portion of the exterior panel is bent to be adjacent to the supporting surface formed at one side of the seesaw cam.

* * * * *